US010247514B2

(12) United States Patent
Chambers

(10) Patent No.: US 10,247,514 B2
(45) Date of Patent: Apr. 2, 2019

(54) WATERPROOF HOLSTER

(71) Applicant: SERCO MOLD, INC, La Verne, CA (US)

(72) Inventor: Darin Chambers, Chino Hills, CA (US)

(73) Assignee: Serco

( * ) Notice: Subject to any disclaimer, the term of this patent is extended or adjusted under 35 U.S.C. 154(b) by 0 days.

(21) Appl. No.: 15/485,183

(22) Filed: Apr. 11, 2017

(65) Prior Publication Data

US 2017/0292808 A1 Oct. 12, 2017

Related U.S. Application Data

(60) Provisional application No. 62/321,327, filed on Apr. 12, 2016.

(51) Int. Cl.

| | |
|---|---|
| ***F41C 33/00*** | (2006.01) |
| ***F41C 33/02*** | (2006.01) |
| ***F41C 33/04*** | (2006.01) |
| ***A45C 11/22*** | (2006.01) |
| *A45F 5/02* | (2006.01) |

(52) U.S. Cl.

CPC ..... *F41C 33/0218* (2013.01); *A45C 11/22* (2013.01); *F41C 33/0263* (2013.01); *F41C 33/046* (2013.01); *A45F 5/021* (2013.01)

(58) Field of Classification Search

CPC ..... F41C 33/0218; F41C 33/046; F41C 33/0263; A45C 11/22; A45F 5/021

USPC ..... 224/661

See application file for complete search history.

(56) References Cited

U.S. PATENT DOCUMENTS

| | | | | |
|---|---|---|---|---|
| 2,455,635 | A | 12/1948 | Witte | |
| 4,912,867 | A * | 4/1990 | Dukes, Jr. | F41A 17/54 224/238 |
| 5,099,596 | A * | 3/1992 | Butler, Jr. | F41A 17/74 42/70.11 |
| 5,303,860 | A * | 4/1994 | Serafini, Jr. | F41C 33/0218 220/324 |
| 6,415,541 | B1 | 7/2002 | Rassias | |
| 6,585,209 | B1 * | 7/2003 | Mattingly | F41C 33/0245 248/121 |
| 6,732,891 | B2 * | 5/2004 | Locklear, III | F41C 33/0209 224/244 |
| 6,752,300 | B2 * | 6/2004 | Har-Shen | F41C 33/0209 224/244 |
| 7,591,402 | B2 | 9/2009 | Rassias | |
| 7,950,553 | B2 * | 5/2011 | Rassias | F41C 33/0236 224/243 |
| 8,622,269 | B2 | 1/2014 | Hogue | |
| 8,720,754 | B2 * | 5/2014 | Kirsch | F41C 33/0236 224/198 |

(Continued)

*Primary Examiner* — Peter N Helvey

(74) *Attorney, Agent, or Firm* — Ascus IP Law, PC; Colin D. Rasmussen

(57) ABSTRACT

A waterproof holster includes articulating main body and cover that come together to form a cavity that is sealed off from the external environment. A sealing component improves the sealing of the main body and cover. The holster includes a latch for opening and closing the main body and cover. The holster also includes within the interior cavity a dock for securing a firearm or other piece of equipment to be stored within the holster. The holster is part of a system including user-wearable accessories such as a belt and leg straps.

15 Claims, 7 Drawing Sheets

(56) References Cited

U.S. PATENT DOCUMENTS

| | | | | |
|---|---|---|---|---|
| 2001/0048009 | A1* | 12/2001 | Vor Keller | F41A 17/066 224/244 |
| 2002/0011504 | A1 | 1/2002 | Cerato | |
| 2007/0181619 | A1 | 8/2007 | Seyfert et al. | |
| 2014/0027479 | A1 | 1/2014 | Hogue | |
| 2014/0097216 | A1* | 4/2014 | Rogers | F41C 33/046 224/243 |
| 2017/0180673 | A1 | 6/2017 | Hyun et al. | |

* cited by examiner

WATERPROOF HOLSTER

PRIORITY CLAIM

This application claims the benefit under 35 U.S.C. § 119(e) of U.S. Provisional Application No. 62/321,327, filed Apr. 12, 2016, and entitled "WATERPROOF HOLSTER", the entirety of which is hereby incorporated by reference.

FIELD OF THE INVENTION

This invention relates to holsters for securing firearms, and in particular holsters that are waterproof.

BACKGROUND

Since the advent of small firearms, there have been a variety of apparatus that have been invented to increase the ease of carrying of weapons, as well as to provide protection to the weapon from the elements such as water, dirt, and other contaminants that could adversely affect the functioning or service life of such weapons. One common type of apparatus is collectively referred to as a holster. Holsters generally share a common theme in that they provide a compartment into which a weapon or other device or piece of equipment may be placed when the weapon is not in actual use. The compartment is frequently attached to a belt or some other kind of system that the user wears on some part of their body, whether it be around the waist, leg or torso. The primary advantage of this kind of arrangement is that it allows a user the freedom of use of their hands when the weapon is not in use, but easy access to the weapon or other item being carried when needed.

There are several prior art examples of holsters that serve to provide increased protection against the elements.

For example:

- U.S. Pat. No. 5,303,860 (Serafini) discloses a holster container that includes a lid to hermetically seal a firearm.
- U.S. Pat. No. 6,415,541 (Rasslas) discloses a holster having a hinged flap, where the weapon is substantially fully enclosed when placed in the holster.
- U.S. Pat. No. 7,591,402 (Rasslas) discloses a holster with a hinged flap that drops away from the top of the holster to permit access to a firearm.
- U.S. Patent Publication 2002-0011504 (Cerato) discloses a casing for pistols that surrounds most of a weapon leaving only the grip exposed to enable the user to remove the weapon from the casing.
- U.S. Patent Publication 2007-0181619 (Seyfert et al.) discloses a holster in which the gun us secured into the holster by a hinged flap that engages the rear of the gun frame near the hammer when the gun is in the body of the holster.

In some cases, holsters are designed to disguise the fact that a person is carrying a firearm. For example:

- U.S. Pat. No. 8,622,269 (Hogue) discloses s holster arrangement that provides a façade the looks like a cell phone case or cover.
- U.S. Patent Publication No. 2014-0027479 (Hogue) discloses another example of a holster that disguises the fact that a handgun is being carried by the user, making use of a hinged shroud to conceal the handgun.

However, each of these prior art examples suffer from notable limitations. For example, all but one of the examples listed above fail to completely protect the firearm from at least some exposure to the elements while in the holster.

Thus, dirt, water and other contaminants that are potentially harmful to the various mechanical parts of the gun can come into contact with critical functional components of the weapon. This can result in damage to the weapon that can adversely affect function both in the short term, and the longer term serviceability of the weapon. Similar issues can exit with pieces of equipment other than firearms that can be stored an carried in holsters.

In the one case of a holster that does provide protection from the elements, the sealing flap is designed in such a way that access to the weapon is inconvenient, and removal of the gun from the holster when needed by a user would be difficult at best (See FIG. 1 of U.S. Pat. No. 5,303,860).

Thus, what is needed is a holster apparatus that effectively secures a weapon or other piece of equipment within the holster, is designed to protect the contents of the holster from the elements, and which permits easy access to the contents of the holster.

SUMMARY OF THE INVENTION

By way of brief summary, the present disclosure relates to the invention of a novel holster that solves many of the problems of prior art holsters. In particular, the present holster provides a protective environment that minimizes contact with the elements when a firearm is stored within it. In addition, the present disclosure provides an apparatus that allows for more convenient access to the weapon, such that a minimum of time is required to extract the weapon or other piece of equipment from the holster when required for use.

In one aspect, the invention provides a cover and main body that cooperatively form a cavity into which a firearm can be placed. Further, the invention further provides a sealing means positioned between the cover and main body such that when the holster is in the closed configuration a waterproof seal is formed, and external contaminants are prevented from entering the interior of the holster cavity.

The cover and main body are secured at one end by a movable hinge, and at an opposite end by a user operated clip. Thus, the cover can be disengaged from the main body and move away by rotating on the hinge, providing access to the contents of the holster.

The holster further comprises a dock, designed to engage the weapon or equipment to be stored in the holster, to reduce the chance of the contents of the holster from falling out when it is opened.

The holster further provides a means of attachment to a belt or other such apparatus normally worn by a user.

Thus, there is provided in some embodiments A waterproof holster, the holster comprising: a main body and a cover, the main body and cover secured to each other by a hinge, the hinge operative to permit movement of the main body and cover relative to each other about the hinge; wherein movement of the main body and cover about the hinge allows the holster to be moved between a closed configuration to an open configuration; wherein when in the closed configuration, the main body and cover cooperatively form an interior cavity in which an object can be stored and protected from exposure to the elements; wherein when in the open configuration, a user can access the interior cavity in order to store or retrieve the object; a holster latch, the holster latch positioned at a location substantially opposition to a location where the hinge is positioned, the latch comprising complimentary structures located on the main body and cover which when engaged maintain the holster in the closed configuration, and when disengaged permit the holster to be moved to the open configuration; a sealing component, the sealing component positioned between an inner aspect of the main body and an inner aspect of the cover, and configured to seal off the inner cavity of the holster off from the exterior environment of the holster when the holster is in the closed configuration; and a dock, the dock configured to receive the object to be stored within the holster, the dock secured to the interior of the holster by a dock hinge.

In some embodiments, the holster latch comprises a spring capable of producing a bias force sufficient to maintain the latch in an engaged configuration.

In some embodiments, the dock further comprises a dock latch, the dock latch configured to maintain the dock in a closed position when engaged, and when disengaged to allow the dock to be moved to an open position.

In some embodiments, the holster latch comprises a spring capable of producing a bias force sufficient to maintain the dock latch in an engaged configuration.

In some embodiments, the sealing component comprises at least one of an O-ring and a gasket. In some embodiments, at least one of the main body and the cover comprises a structure shaped to substantially conform to the shape of the sealing component. In some embodiments, when the holster is in the closed configuration, the main body, cover and latch cooperatively produce a compressive force on the sealing component such that the effectiveness of the sealing component is increased. In some embodiments, the holster is waterproof to a depth of at least 30 feet.

In some embodiments, the dock is configured to frictionally engage the object such that the object is prevented from inadvertently coming out of the dock.

In some embodiments, the dock is configured to be reversibly deformable.

In some embodiments, the object to be stored in the holster is a firearm, and the dock is configured to receive a portion of the firearm. In some embodiments, the portion of the firearm received by the dock is the barrel.

In some embodiments, the holster further comprises an accessory compartment. In some embodiments, the holster further comprises a user wearable belt. In some embodiments, the holster further comprises at least one user wearable leg strap configured to limit motion of the holster relative to a user when the user is moving.

BRIEF DESCRIPTION OF THE DRAWINGS

Preferred embodiments of the present invention are described herein, with reference to the accompanying drawings, in which.

DESCRIPTION OF THE INVENTION

The present invention provides a novel and improved holster system for weapons. While the depicted embodiments are related to the use of the invention in conjunction with small arms, it will be apparent to those of skill in the art that the system could be readily adapted for use with other types of weapons, including rifles and the like.

Figure 1:
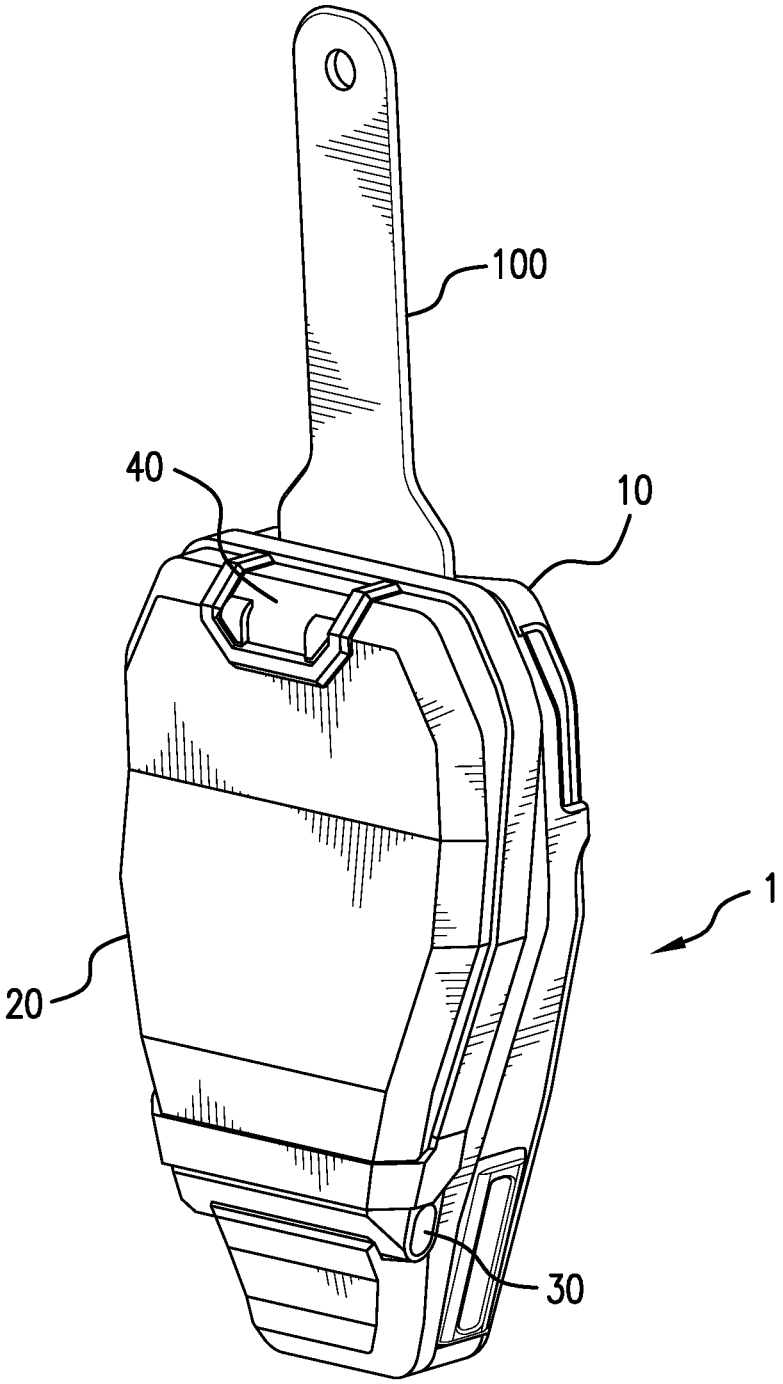
FIG. 1 is a perspective view of an embodiment of a waterproof holster in the closed and sealed configuration.

As seen in the accompanying drawings, for example as shown in FIG. 1, a waterproof holster 1 comprises a main body 10, a moveable cover 20, wherein the cover is connected to the main body via a hinge 30 and a latch 40 that is designed to maintain the body and cover in a closed configuration, but when released allows the cover and main body to separate at their ends by rotation about the hinge 30.

Figure 2:
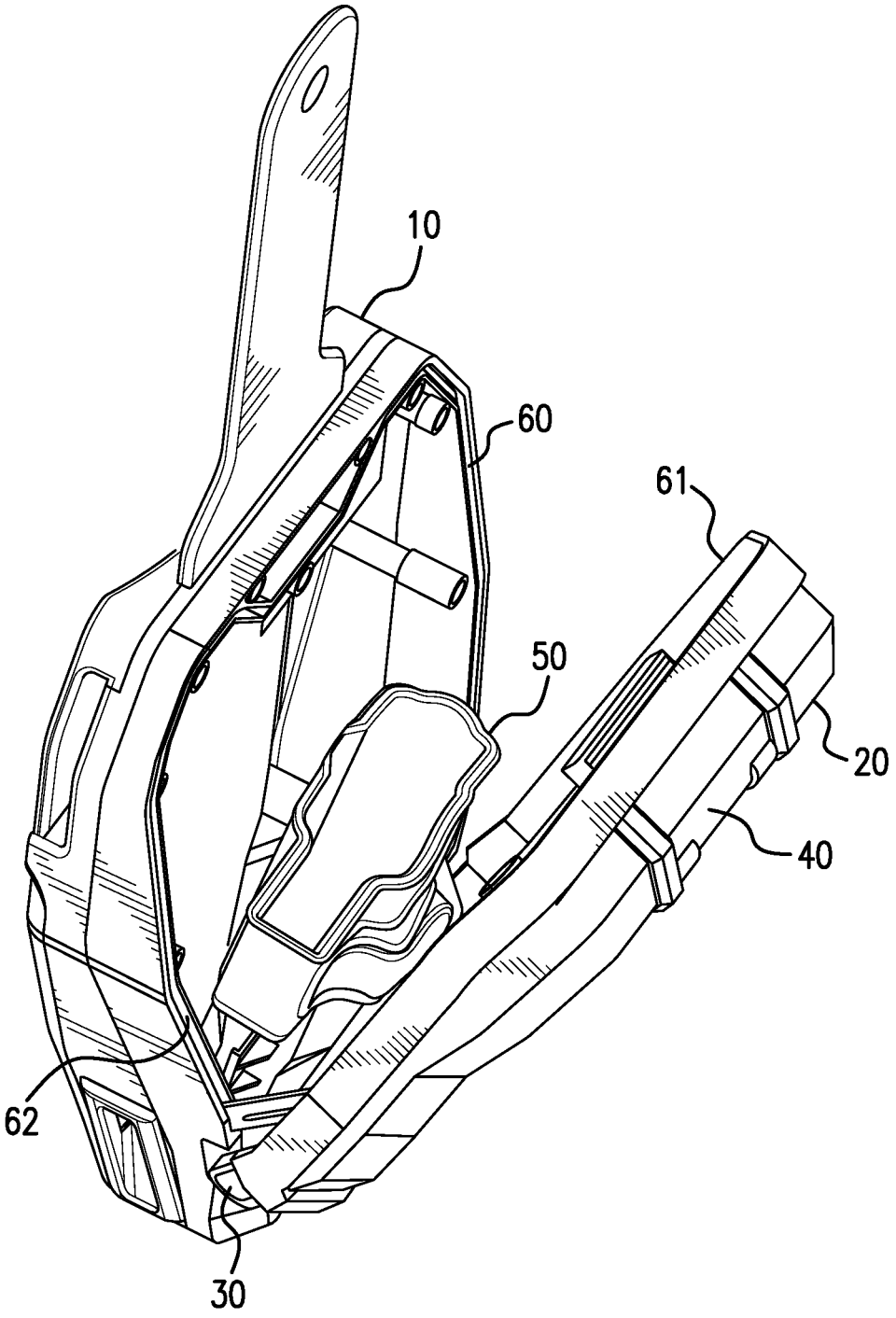
FIG. 2 is a top perspective view of an embodiment of a waterproof holster in the open configuration, showing a dock in which a firearm can be secured within the body of the holster.

Referring to FIG. 2, it can be seen that in some embodiments the main body and cover of the holster each have an inner aspect 60, 61 the shapes of which are complimentary to each other. These inner aspects are operative to form a tight fit between the main body and cover, such that they form a seal that isolates the interior of the holster from the outside environment when the main body and cover are in the closed and latched configuration. In some embodiments, the inner aspects can be fashioned such that the shapes fit sufficiently well to provide a seal without the need for additional components. In other embodiments, the inner aspect can be shaped to receive a sealing component 62, for example a gasket or O-ring such as those well known to those of skill in the art. In some cases, it will be desirable to design the fit of the main body and cover, such that when in the closed configuration, the sealing component is placed under compression to further improve the integrity and operation of the sealing component.

The sealing component may be made of a variety of materials, both natural and synthetic, including rubbers, silicone, cork, and other materials commonly used in the manufacture of seals and gaskets. Conveniently, the sealing component can be made to be replaceable, such that over time, if there is wear of the seal, or if it becomes damaged or otherwise compromised, it can be replaced should it lose its effectiveness in sealing the interior of the holster against the outside elements. In some embodiments, portions of the inner aspects of the main body and cover, 60, 61 can be shaped to substantially conform to the shape of the sealing component 62. For example, where the sealing component comprises a traditional O-ring, each of the inner aspects can have a channel shaped to receive half of the O-ring. Thus, when in place the O-ring will seat within the complimentary channels providing a more effective seal. In some cases, only one of the inner aspects of the main body or cover will include a channel to receive the sealing component and the other will have a flat surface against which the sealing component will be compressed when the cover and main body are in the closed configuration. This is another effective form of provide sealing of the inside of the holster and protecting a weapon from the elements.

With respect to the sealing mechanism, a number of possible configurations are possible for use with the present invention. As discussed above, in one case it may be preferable for the sealing means to comprise a gasket or O-ring style seal, that is positioned within a channel. A channel could be formed in the main body and/or the cover portion of the holster. In some embodiments, have complimentary channels in both the cover and main body would serve to provide a means of ensuring the sealing gasket or like component was correctly aligned so as to form a waterproof seal when the cover is secured to the main body in the closed configuration. Gaskets or seals could fit by friction alone, or in combination with an adhesive such as a glue, gasket compound, or silicone grease. In some cases, a sealing gasket could be permanently mounted, in others it may be preferable to allow for a removable seal for ease of maintenance.

As will be apparent, when the holster is in the closed configuration, the sealing component will provide a contiguous seal between the main body and the cover, thus preventing external contaminants from entering the interior of the holster and adversely affecting a weapon or any other piece of equipment that might be stored within. Depending on the extent of protection from the elements required, the seal can be water resistant, waterproof, and potentially waterproof to a significant depth, such as 30 feet or more.

As can also be appreciated from the drawings, the cover and main body are shaped such that they cooperatively form a cavity into which a handgun or other similar weapon or some other device or piece of equipment will fit when the holster is in the closed configuration. The precise dimensions of the cavity are not intended to be limiting to the scope of the invention. Many different possible shapes and sizes of cover and main body are thus contemplated to be adaptable to range of sizes of weapons or devices intended to be contained within the holster. Likewise, the holster is not limited to use with firearms but can be adapted for use with other pieces of equipment such as hand tools or electronic devices, or any other piece of equipment that a user would like to have at the ready while being able to provide a waterproof environment within the holster to protect items stored within.

Conveniently, the holster of the present disclosure is designed such that the cover opens laterally away from the main body. This is a significant advance over prior art designs and provides for significantly easier access to the contents of the holster. For example, and as shown in FIG. 1, a latch 40 on the upper aspect of the cover provides a means to engage and disengage the top of the cover to and from the main body. At the opposite end of the cover, a hinge 30 is connects the cover to the main body. In general, the hinge is meant to provide a constant point of attachment of the cover to the main body, although it is expected that in order to service or repair the holster the hinge could be made to be capable of disassembly. The hinge can also be designed to allow movement of the cover relative to the main body over a wide range of angles.

The latch can also be further configured to provide an additional bias force to maintain close contact between the cover and main body when in the closed configuration, which in turn assists the seal/gasket in maintaining a waterproof seal when the cover is secured. In some cases, the latch includes a mechanism that allows for easy opening by pressing with a thumb or finger to disengage the latch allowing the cover to swing away from the main body on the hinge. A variety of latch arrangements are possible for use, and so the precise design of a clip mechanism is not considered to be limiting to the scope of the invention. In some cases, the latch may include a spring mechanism to provide resistance to avoid inadvertent actuation of the latch that might otherwise result in accidental opening of the holster.

Figure 3:
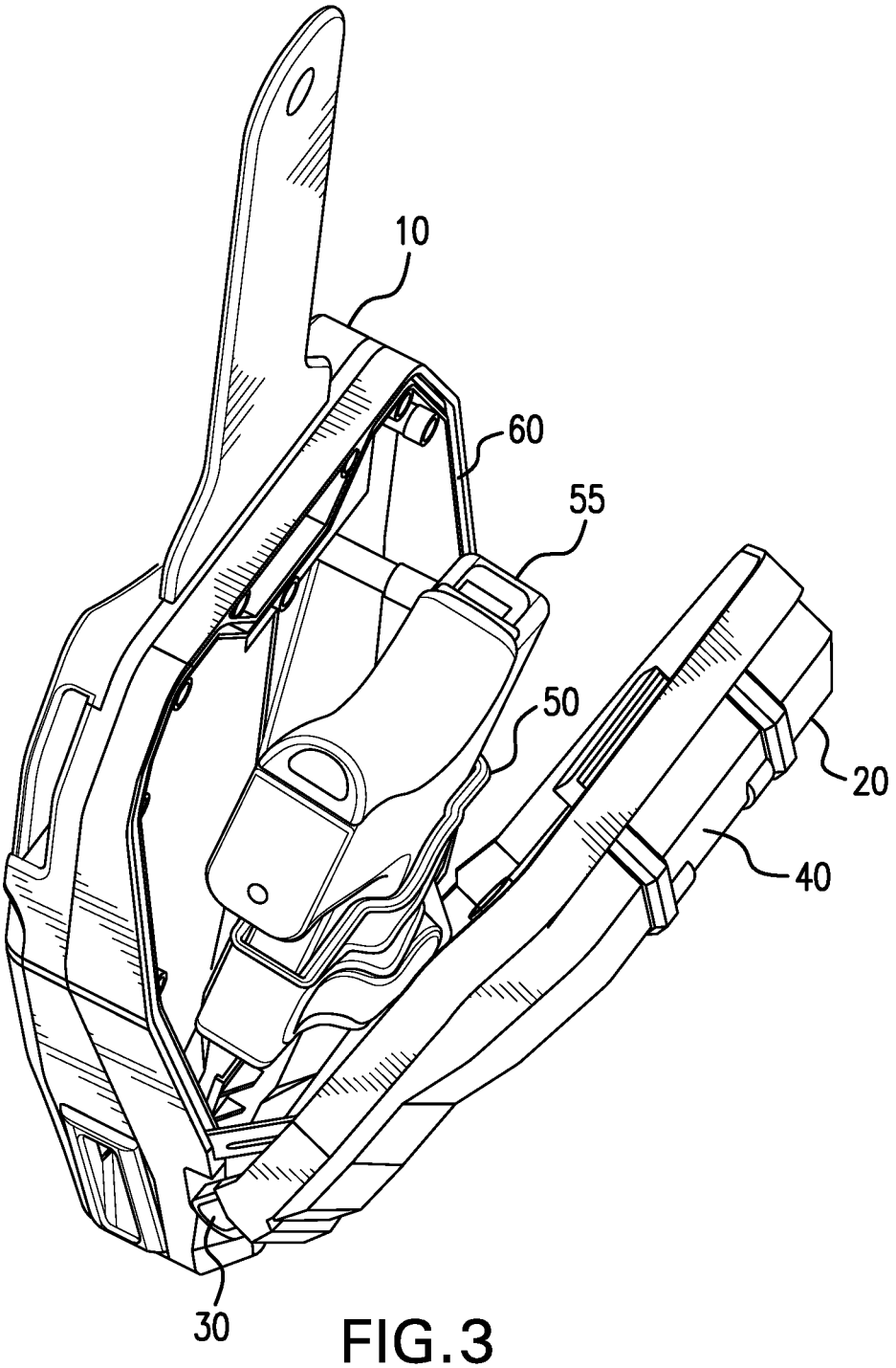
FIG. 3 is another top perspective view of an embodiment of a waterproof holster, showing a firearm within the body of the holster and where a part of the barrel of the weapon is secured within a dock.

As can be seen in FIGS. 2 and 3, those of skill in the art will appreciate that a hinge can be positioned such that it is outside the perimeter of the cavity formed by the cover and main body. This conveniently allows for virtually any style of hinge to be used, without the requirement that the hinge also be waterproof. In these exemplary embodiments, the latch and hinge are arranged so that the latch is toward the top of the holster as it would be worn by a use, and the hinge towards the bottom. Thus, under normal circumstances, a user, when using the holster would actuate the latch to open the cover, which would rotate about the axis of the hinges, swinging in a directionally generally away from the body of the user. The cavity of the holster would then be accessible from the top portion of the holster, making it easy for the user to access the contents contained therein.

Other placements of the latch and hinge are also possible. For example, it may be desirable to place a hinge on a side aspect of the cover and main body so that the cover still opens away from the main body, but along a different axis than that depicted in the drawings. This would still allow for easy access to the weapon or device by the user but could provide an ergonomic advantage in terms of the hand positioning required to access the contents of the holster. The precise location of the latch and hinge are not limiting to the scope of the present disclosure.

Figure 6:
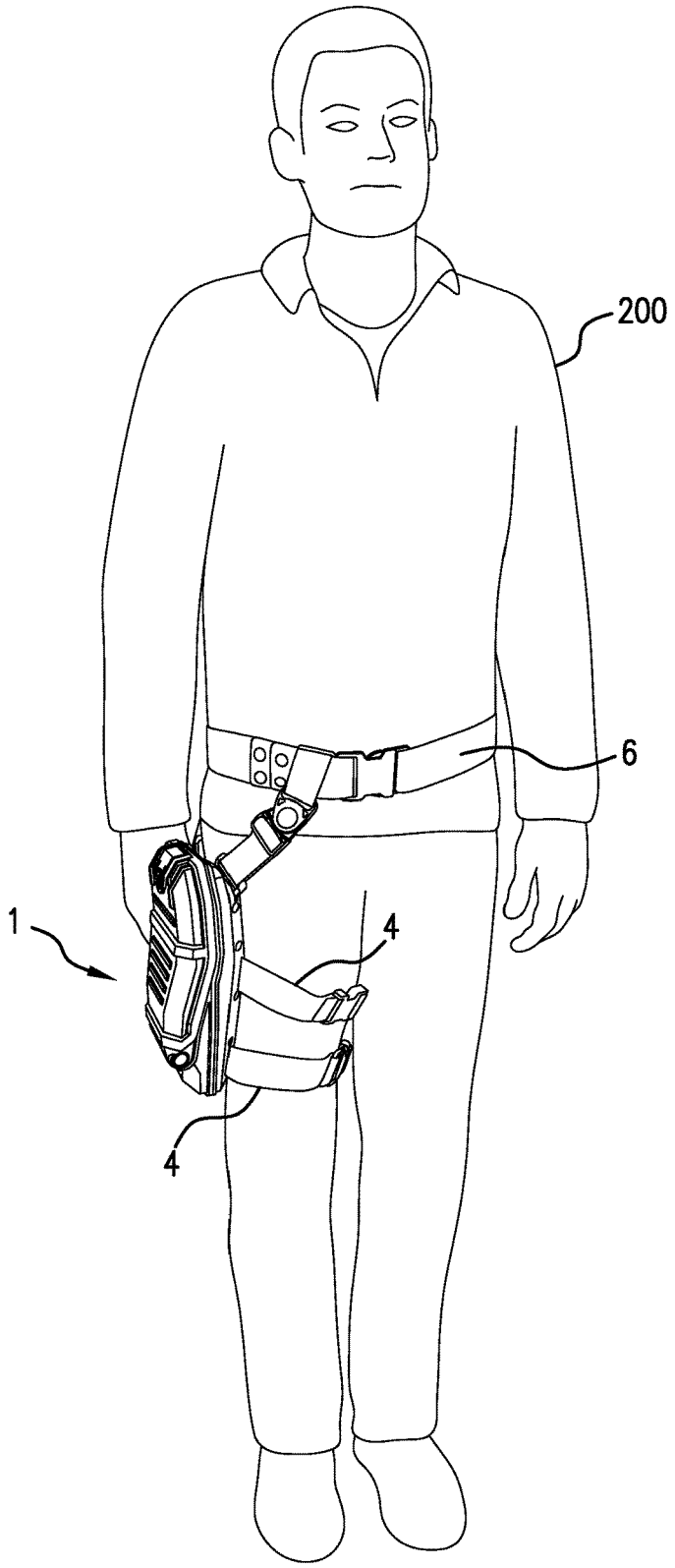
FIG. 6 depicts an embodiment of a holster of the present disclosure attached to a user-wearable belt that includes leg straps, being worn by a user.

Referring to FIG. 1, one can see that in a preferred embodiment the latch is positioned generally at the top of the holster, with respect to how the holster would normally be worn by a user (See FIG. 6). Imagining now that the latch is positioned at a location 90° counter-clockwise, in another embodiment the latch would be positioned at the back aspect of the holster. In this configuration, the hinge would be logically located at the front of the holster rather than towards the bottom as shown in the drawings. One can easily picture that in this type of arrangement that when the latch was disengaged, the cover would swing along a back to front axis rather than a top to bottom axis. This would allow the user to reach into the holster to grasp and remove the gun in a back and forth motion that is more natural with respect to the physiological orientation of the hand, lower, and upper arm structures.

In still another embodiment, the holster can be designed so that the latch is at the front of the holster and the hinge towards the rear. This arrangement would still result in the cover opening laterally away from the main body, and would provide an ergonomic advantage for accessing the contents of the holster using the hand opposite to the side of the body on which the holster is worn. For example, in this arrangement, the holster could be worn on the right side of the body and the contents more easily accessed by the left hand in a motion where the hand would be brought across the body to open and reach into the holster.

Figure 4A:
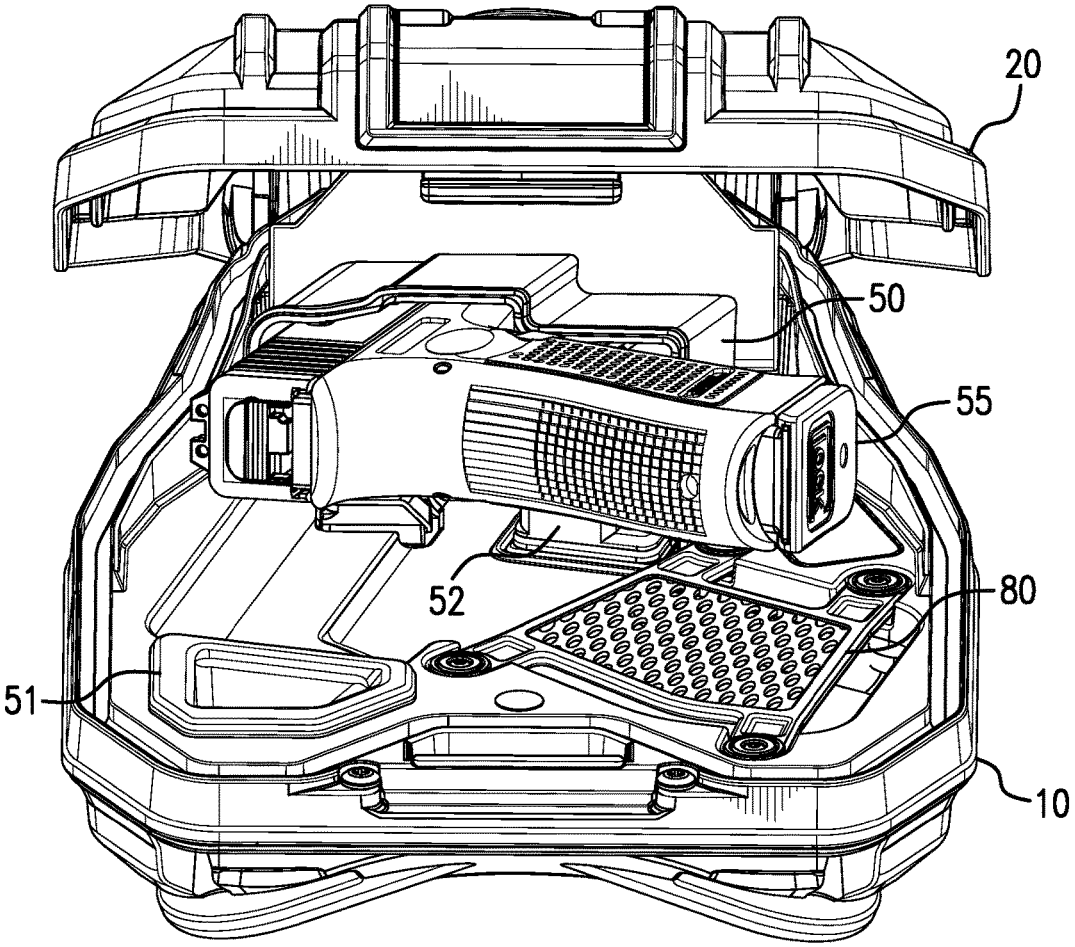
FIG. 4A depicts an embodiment of a waterproof holster, where the weapon is removed to provide a better view of the dock into which the barrel of the firearm is placed, and where the dock is in the secured configuration.
Figure 4B:
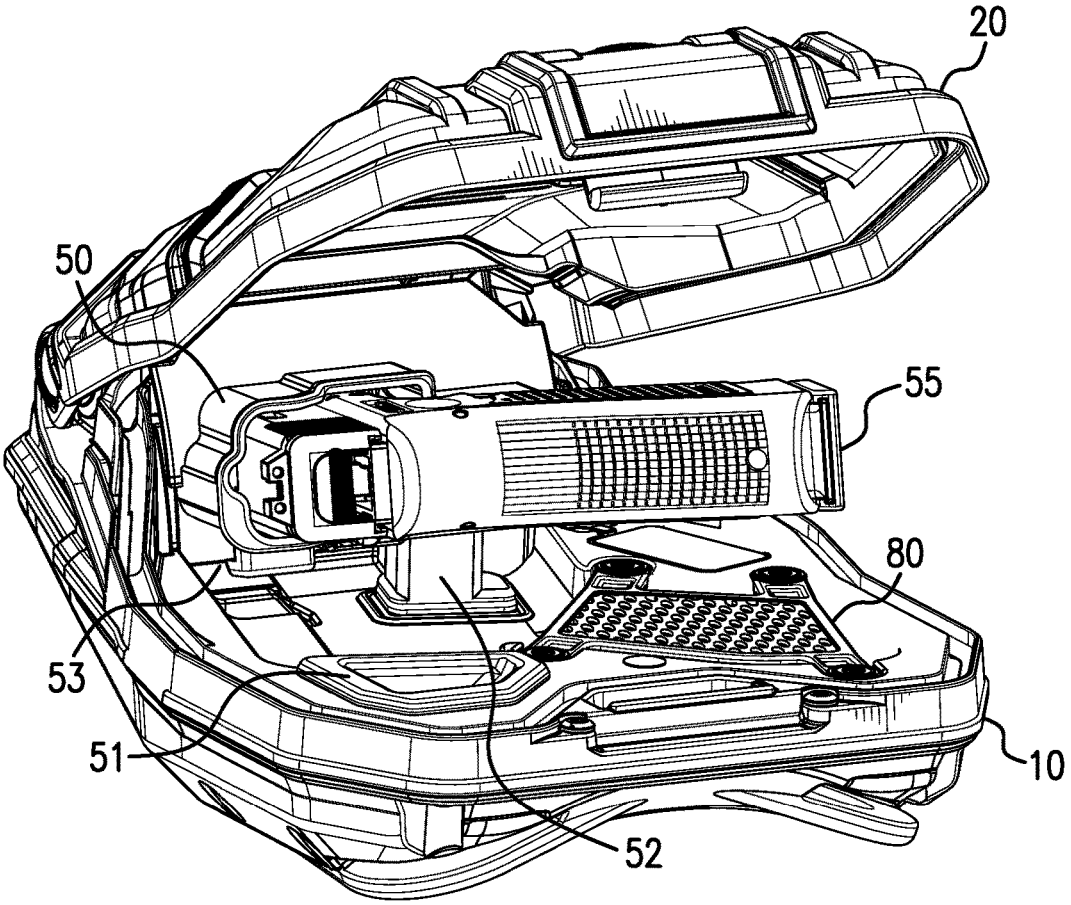
FIG. 4B depicts an embodiment of a waterproof holster, where the weapon is removed to provide a better view of the dock into which the barrel of the firearm is placed, and where the dock is in the open configuration.

As shown in FIGS. 2, 3, 4A and 4B, the holster can also include an engagement structure, or dock 50, that is designed to be able to receive a part of a firearm, for example a portion of the barrel, and maintain it in a semi-secured position within the holster, even when the holster is in the open configuration. As can be seen in FIG. 3 and FIGS. 4A and 4B, one embodiment of the dock can be configured to receive a portion of the barrel of the firearm 55. This provides the user with the convenience of not having to guard against the firearm falling out of the holster as it is opened. The dock can be configured to accept a wide variety of barrel shapes and sizes. Conveniently, the dock may be configured such that the weapon fits relatively snugly and is held in place by friction.

In still other cases, it might be preferable to provide a compliant dock that can deform to the shape of the barrel of the gun being placed in the holster. In this case, the dock would function as a "one size fits all" structure designed to be able to relatively easily deformed to engage any of a number of different shaped and sized gun barrels or other items that a user may wish to store within the holster.

As shown in FIGS. 4A and 4B, the dock 55 can be made to be pivotable such that it is able to be moved from a closed position (FIG. 4A) to an open position (FIG. 4B). When in the open position it will be easier for the user to grasp the firearm or other object in order to remove it from the dock and holster. As with the main body and cover, in one embodiment the dock includes a dock hinge structure 53 to allow this pivoting action. The dock hinge can be secured to the interior of the holster, preferably to an inner surface of the main body. When in the open position, the weapon will be more easily removable from the dock by a user. The dock can also include its own latching mechanism. The dock latch mechanism is designed to allows the dock to be secured and maintained in the closed position, and then released into the open position by operation of the dock latch. Releasing the dock from the closed position can be accomplished by a user operated dock latch 51 or other similar type of release. As with the latching mechanism that secures the cover and main body, the dock latch can include a spring mechanism or other source of bias force that requires a user to press on the dock latch in order to open the latching mechanism and release to dock into the open position. Similar in operation to the latch securing the cover and main body, the dock latch would prevent inadvertent release of the dock from the closed position. In one embodiment, the dock can also include a dock pedestal 52. The dock pedestal can provide an additional point of support in addition to the dock hinge, and can operate cooperatively with the dock latch 51 for smoothness of move the dock from a close to open position and back again. The dock pedestal can be designed to include a spring that provides a bias force that pushes the dock towards the open position when the dock latch is released. The dock latch can also include a mechanism that creates a bias force (e.g., a spring) to prevent inadvertent opening of the latch.

Figure 5:
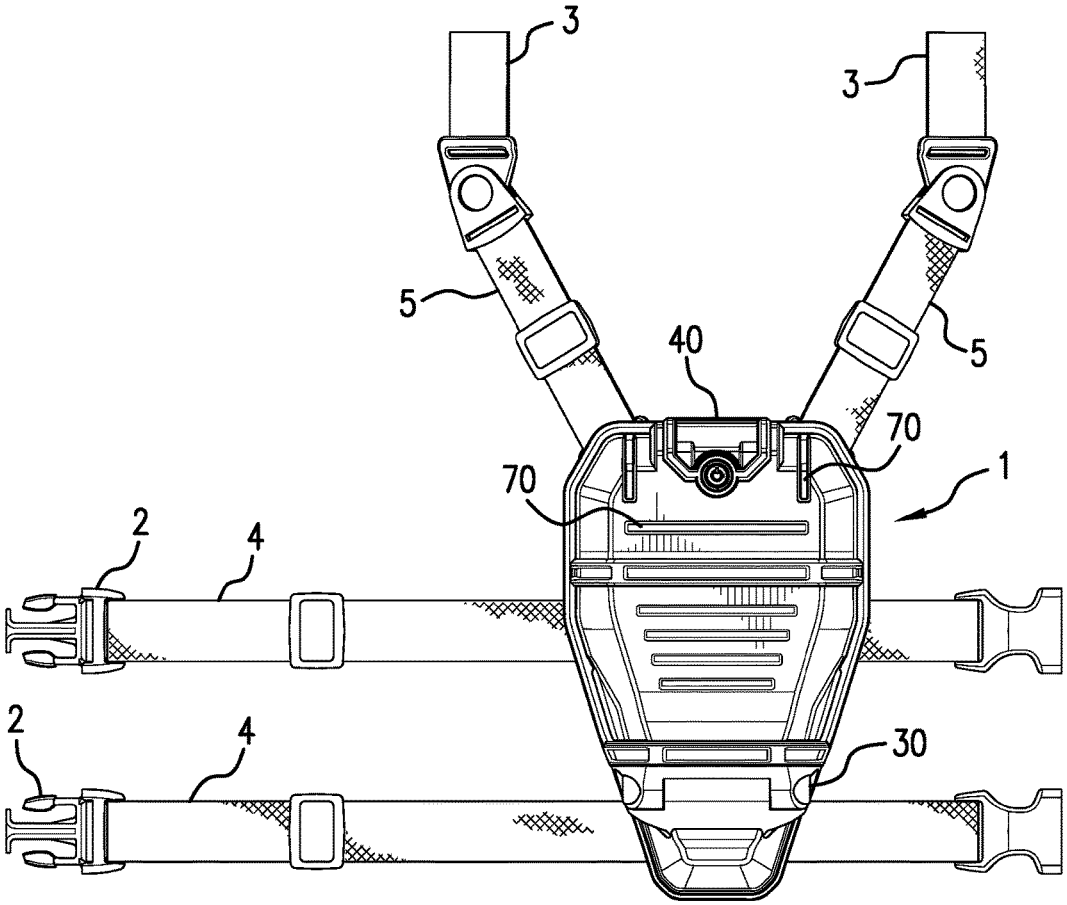
FIG. 5 depicts an embodiment of a holster of the present disclosure attached to a user-wearable belt that includes leg straps.

The holster can also further comprise an attachment structure 100, designed to secure the holster to a gun belt or other similar type of device intended to be worn by a user. The holster may also be provided as part of a system that also includes a user-wearable belt 6, as is common with other prior art holsters. The system can also include one or more hangar straps 5 that include loops 3 or similar structure to engage a belt 6 worn by a user 200. The system may also include leg straps 4 to allow a user to further secure the holster on position as shown in FIG. 5 and FIG. 6, by engaging clips 2 or similar attachments located on the ends of one or more leg straps. Leg straps would be operative to prevent the holster from flopping against the side of the leg of the user when the user was in motions, for example when running. Conveniently the leg straps, hangars, and belt could all be sized to be conformable or adjustable to the size of the user to provide a more secure fit of the entire system when in use. This could be accomplished using stretchable straps that elastically tighten about the leg, or with adjustable straps, who's length could be adjusted, or a combination of these two types of straps.

The surface of the holster can also be textured to include ribs 70 or other similar tactile cues to allow a user to operate the various functional mechanisms by feel and without having to directly look at the holster. This can be convenient in dark environments, or where it is advantageous to maintain visual contact with a target or threat.

As shown in FIGS. 4A and 4B features of the holster can also include such things as an accessory storage compartment 80. An accessory storage compartment could provide a convenient place to store items other than a weapon or tool, for example a silica gel package to maintain a relatively dry interior environment when the holster is closed and sealed. This might also be advantageous when storing objects within the holster for extended periods of time in humid environments.

Components of the holster can be fashioned from a number of materials including plastics, metals, and any other suitably waterproof materials, or combinations thereof. In some cases, the components can be fashioned using processes such as, but not limited to, multi-axis CNC machining, 3-D printing, or injection molding.

It will be apparent to those skilled in the art that many more modifications besides those already described are possible without departing from the inventive concepts herein. For example, it will be realized that the optimal dimensions for the various parts of the invention, materials, shape, form, manner of assembly, and operation or use will be apparent to those of skill in the art. The inventive subject matter, therefore, is not to be restricted except in the scope of any appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. All suitable modifications and equivalents that may be resorted to are thereby considered to be within the scope of the present invention.

The invention claimed is:

1. A waterproof holster, the holster comprising:

a main body and a cover, the main body and cover secured to each other by a hinge, the hinge operative to permit movement of the main body and cover relative to each other about the hinge;

wherein movement of the main body and cover about the hinge allows the holster to be moved between a closed configuration to an open configuration;

wherein when in the closed configuration, the main body and cover cooperatively form an interior cavity in which a weapon can be stored and protected from exposure to the elements;

wherein when in the open configuration, a user can access the interior cavity in order to store or retrieve the weapon;

a holster latch, the holster latch positioned at a location substantially opposition to a location where the hinge is positioned, the latch comprising complimentary structures located on the main body and cover which when engaged maintain the holster in the closed configuration, and when disengaged permit the holster to be moved to the open configuration;

a sealing component, the sealing component positioned between an inner aspect of the main body and an inner aspect of the cover, and configured to seal off the inner cavity of the holster off from the exterior environment of the holster when the holster is in the closed configuration; and a dock, the dock movable between an open position and a closed position, the dock secured to the interior of the holster by a dock hinge; wherein the dock is configured to engage a portion of the weapon to be stored within the holster; wherein the portion of the weapon to be engaged by the dock is a barrel; and wherein the dock is configured such that the dock surrounds a portion of the barrel of the weapon when the weapon is engaged by the dock.

2. The holster of claim 1, wherein the holster latch comprises a spring capable of producing a bias force sufficient to maintain the latch in an engaged configuration.

3. The holster of claim 1, wherein the dock further comprises a dock latch, the dock latch configured to maintain the dock in a closed position when engaged, and when disengaged to allow the dock to be moved to an open position.

4. The holster of claim 3, wherein the holster latch comprises a spring capable of producing a bias force sufficient to maintain the dock latch in an engaged configuration.

5. The holster of claim 1, wherein the sealing component comprises at least one of an O-ring and a gasket.

6. The holster of claim 1, wherein at least one of the main body and the cover comprises a structure shaped to substantially conform to the shape of the sealing component.

7. The holster of claim 1, wherein when the holster is in the closed configuration, the main body, cover and latch cooperatively produce a compressive force on the sealing component such that the effectiveness of the sealing component is increased.

8. The holster of claim 1, wherein the holster is waterproof to a depth of at least 30 feet.

9. The holster of claim 1, wherein the dock is configured to frictionally engage the weapon such that the weapon is prevented from inadvertently coming out of the dock.

10. The holster of claim 9, wherein the dock is configured to be reversibly deformable.

11. The holster of claim 1, wherein the weapon comprises a firearm.

12. The holster of claim 11, wherein the portion of the firearm received by the dock is the barrel.

13. The holster of claim 1, further comprising an accessory compartment.

14. The holster of claim 1, further comprising a user wearable belt.

15. The holster of claim 14, further comprising at least one user wearable leg strap configured to limit motion of the holster relative to a user when the user is moving.

* * * * *